US011952840B2

(12) United States Patent
Clark et al.

(10) Patent No.: US 11,952,840 B2
(45) Date of Patent: Apr. 9, 2024

(54) MANAGED PRESSURE DRILLING SYSTEM AND METHOD OF USE

(71) Applicant: DEEP BLUE OIL & GAS LIMITED, Aberdeen (GB)

(72) Inventors: Alan Clark, Aberdeen (GB); Alan Reid, Aberdeen (GB)

(73) Assignee: DEEP BLUE OIL & GAS LIMITED, Aberdeen (GB)

( * ) Notice: Subject to any disclaimer, the term of this patent is extended or adjusted under 35 U.S.C. 154(b) by 0 days.

(21) Appl. No.: 17/635,806

(22) PCT Filed: Aug. 17, 2020

(86) PCT No.: PCT/GB2020/051961
§ 371 (c)(1),
(2) Date: Feb. 16, 2022

(87) PCT Pub. No.: WO2021/032964
PCT Pub. Date: Feb. 25, 2021

(65) Prior Publication Data

US 2022/0290504 A1 Sep. 15, 2022

(30) Foreign Application Priority Data

Aug. 16, 2019 (GB) ..... 1911822

(51) Int. Cl.
*E21B 17/02* (2006.01)
*E21B 17/00* (2006.01)
(Continued)

(52) U.S. Cl.
CPC ..... *E21B 17/02* (2013.01); *E21B 17/00* (2013.01); *E21B 21/08* (2013.01); *E21B 33/03* (2013.01)

(58) Field of Classification Search
CPC ..... E21B 17/02; E21B 21/08; E21B 33/03; E21B 17/00; E21B 17/04
See application file for complete search history.

(56) References Cited

U.S. PATENT DOCUMENTS 1,562,372 A 11/1925 Sheldon
1,919,931 A * 7/1933 Craig ..... E21B 17/00 175/320

(Continued)

FOREIGN PATENT DOCUMENTS

CN 203476222 U 3/2013

OTHER PUBLICATIONS

International Search Report for PCT/GB2020/051961 dated Nov. 20, 2020.

*Primary Examiner* — Brad Harcourt
(74) *Attorney, Agent, or Firm* — FisherBroyles, LLP

(57) ABSTRACT

The invention provides a managed pressure drilling system. The system comprises a rotating sealing device and a drill string assembly comprising a plurality of drill pipe members. Each drill pipe member has a first tool joint having a first tool joint outer diameter; a second tool joint having a second tool joint outer diameter; and a tubular body between the first and second tool joints having a tubular body outer diameter. In at least one section of the drill string the first tool joint outer diameter, the second tool joint outer diameter and the tubular body outer diameter are substantially the same. The rotating sealing device is configured to form a fluid seal against at least a part of the at least one section of drill string.

21 Claims, 8 Drawing Sheets

(51) Int. Cl.
*E21B 21/08* (2006.01)
*E21B 33/03* (2006.01)

(56) References Cited

U.S. PATENT DOCUMENTS

| | | | | |
|---|---|---|---|---|
| 5,370,183 | A * | 12/1994 | Ellis | E21B 29/10 166/55.7 |
| 2002/0145423 | A1* | 10/2002 | Yoo | G01N 27/82 324/235 |
| 2004/0244964 | A1 | 12/2004 | Hall et al. | |
| 2008/0210471 | A1 | 9/2008 | Bailery et al. | |
| 2010/0012317 | A1 | 1/2010 | Shelton | |
| 2011/0024195 | A1 | 2/2011 | Hoyer et al. | |
| 2012/0118559 | A1* | 5/2012 | Li | E21B 33/085 166/84.3 |
| 2012/0298249 | A1 | 11/2012 | Banker | |
| 2014/0353045 | A1 | 12/2014 | Zhang et al. | |
| 2016/0222751 | A1 | 8/2016 | Bullock et al. | |
| 2017/0247972 | A1 | 8/2017 | Faugstad | |
| 2020/0190924 | A1* | 6/2020 | Faugstad | E21B 21/08 |

* cited by examiner

MANAGED PRESSURE DRILLING SYSTEM AND METHOD OF USE

This application is the U.S. National Stage of International Application No. PCT/GB2020/051961, which was filed on Aug. 17, 2020. This application also claims the benefit of the filing date of GB patent application No. GB1911822.3 which was filed on Aug. 16, 2019. The contents of both of these applications are hereby incorporated by reference.

The present invention relates to a Managed Pressure Drilling (MPD) system and method of use and in particular to drill pipe assemblies for use in managed pressure drilling operations. Particular aspects of the invention relate to managed pressure drilling for onshore and offshore wells.

BACKGROUND TO THE INVENTION

Drilling operations typically use a rotating drill bit on the end of a drill string. Managed Pressure Drilling (MPD) is a form of drilling where the annular pressure throughout a wellbore is precisely controlled.

In MPD operations the annular pressure is kept slightly above the pore pressure to prevent the influx of formation fluids into the wellbore, but it is maintained below the fracture initiation pressure. The dynamic control of annular pressures in managed pressure drilling enables a well to be drilled in conditions where the local geology makes conventional drilling difficult or impossible.

Mud is pumped down the drill string from a mud pumping system and returned to the surface flowing in the annulus between the drill string and the well to allow sand and cuttings to be removed from the well. The mud circulation system is a closed loop with returning mud flowing into manifolds that can apply backpressure. The annulus is sealed around the drill string while the drill string rotates typically using a rotating control device (RCD). The MPD process may additionally or alternatively control mud density, annular fluid level adjustment or circulating friction.

Conventional rotating control devices comprise an internal sealing element which seals around the outside diameter of the drill string and rotates with the drill string during drilling. As the wellbore is drilled the drill string is run through the RCD. The continuous movement of the drill string through the sealing element of the RCD causes wear of sealing surface of the sealing element.

The sealing elements are required to be regularly replaced to maintain an effective seal. The replacement of the sealing element results in a loss of rig drilling time and poses safety issues to rig personnel.

MPD systems have proven effective in different well types including vertical, horizontal, deviated and unconventional well designs in offshore and onshore environments. Typically drill strings are required to be strong and flexible to allow drilling of horizontal, highly deviated and long reaching bores.

SUMMARY OF THE INVENTION

There is need for a drill pipe apparatus which addresses one or more of the problems associated with known prior art systems, including those identified above.

It is amongst the aims and objects of the invention to provide a drill pipe apparatus for managed pressure drilling which prevents or mitigates wear of annular seals or seal elements.

It is a further object of the present invention to provide a method of performing managed pressure drilling in deviated or horizontal wells which mitigates the frequency with which annular seals or seal elements are worn and require replacement.

According to a first aspect of the invention, there is provided a managed pressure drilling system for use in managed pressure drilling operations, the system comprising:

a rotating sealing device; and a drill string comprising a plurality of drill pipe members arranged in at least a first drill string section and a second drill string section;

wherein each drill pipe members comprises a first tool joint having a first tool joint outer diameter;

a second tool joint having a second tool joint outer diameter; and a tubular body between the first and second tool joints having a tubular body outer diameter, wherein the first tool joint outer diameter and second tool joint outer diameter are larger than the tubular body outer diameter in each of the drill pipe members in the first drill string portion;

wherein the first tool joint outer diameter and the second tool joint outer diameter are substantially the same as the tubular body outer diameter in each of the drill pipe members in the second drill string section; and wherein the rotating sealing device is configured to form a fluid seal against an outer surface of the second drill string section.

Preferably the first and second tool joints of the drill pipe members in the second drill string section are flush with the outer surfaces of the drill pipe member tubular body. The first and second tool joints of the drill pipe members in the second drill string section may have substantially the same diameter than the tubular body diameter of the drill pipe members.

The first tool joint and/or the second tool joint in each of the drill pipe members in the first drill string portion may have an upset. The upset may be an external and/or internal upset. The outer diameter of the upset may be larger than the tubular body outer diameter in each the drill pipe members in the first drill string section.

The first tool joint and/or the second tool joint in each of the drill pipe members in the second drill string portion may have an internal upset. The internal upset may be configured to not extend the outer diameter of the first tool joint and/or the second tool joint in each of the drill pipe members in the second drill string section beyond the tubular body outer diameter in each drill pipe members in the second drill string section.

The first and/or second tool joints of the drill pipe members in the first drill string portion or section may protrude or extend beyond the outer surfaces of the drill pipe members such as the tubular body outer diameter in each drill pipe members in the first drill string section. The first and/or second tool joints of the drill pipe members in the first drill string section may have a larger outer diameter than the tubular body diameter of the drill pipe members in the first drill string section.

The rotary sealing device may be configured to form a fluid seal against at least a part of an outer surface of the second drill string section.

By providing a second drill string section having drill pipe members with tool joints which are substantially the same diameter as the main tubular body and a first drill string section with each drill pipe members having tool joints with a larger diameter than the main tubular body (such as having an upset), the invention may facilitate the drilling of wells that deviate from the vertical while maintaining a robust effective seal around a surface of the second drill string section.

The second drill string section may be configured to be located in a substantially vertical portion or section of the wellbore bore in a well, riser, liner and/or casing. The second drill string section may be configured to be located in a substantially non-horizontal or non-deviated portion or section of the wellbore bore in a well, riser, liner and/or casing.

The first drill string section may be connected to a drill bit. The first drill string section may be configured to be located in a substantially non-vertical portion or section of the wellbore to allow the drill bit connected at a lower end of the first drill string section to drill in a deviated or horizontal well. The first drill string section may be configured to be located in a deviated or substantially horizontal portion or section of the wellbore. The first drill string section may be configured to be located in a substantially S-shaped portion or section of the wellbore.

The rotating sealing device may be a surface pressure control device such as a rotary control device (RCD). The rotary control device may comprise at least one sealing element configured to contact, form and/or maintain a fluid seal against at least one drill pipe member in the second drill string section or a part of at least one drill pipe member in the second drill string section. The RCD may contact an outer surface of a part of the second drill string section to form a seal.

The second drill string section may have a generally smooth surface without any protruding or irregular surfaces from tool joints, upsets and/or drill collars. The continuous outer surface diameter of the second drill string section along its longitudinal length may enable sealing elements in an RCD to maintain a robust effective seal around a surface of the second drill string section. The continuous outer surface diameter of the second drill string section along its longitudinal length may enable sealing elements in an RCD to maintain a robust effective seal around a surface of the second drill string section as the second drill string section is raised and/or lowered through the RCD.

By providing a second drill string section with flush tool joints, the second drill string section or part thereof may be moved through the RCD and/or through the sealing element during a drilling operation while the sealing element is under pressure and mitigating damage or wear to an interior sealing surface of the sealing element. The lifespan of the sealing element may be extended and a long term seal be maintained. The RCD may be configured to operate in annular wellbore fluid pressures in the range of 2000 psi to 10000 psi.

The first tool joint of the drill pipe members in the first and/or second drill string sections may be a box section and the second tool joint of the drill pipe members in the first and/or second drill string sections may be a pin section. Alternatively, the first tool joint may be a pin section and the second tool joint may be a box section.

Preferably the second drill string section has an outer diameter that is substantially uniform along its longitudinal length.

Each drill pipe member of the first drill string section may have opposite longitudinal first and second ends and a middle portion extending between the first and second ends. The first and second ends may have a first outer diameter and the middle portion having a second outer diameter less than the first outer diameter.

The rotating sealing element may be configured to seal around an outer diameter of part of the second drill string section and rotate with the second drill string section.

One end of the second drill string section may be configured to be connected to one end of the first drill string section. Preferably a lower end of the second drill string section may be configured to be connected to an upper end of the first drill string section.

The term "lower end" refers to the portion of the drill string section located at a downhole end of the drill string section. The term "upper end" refers to the portion of the drill string section located at an uphole end of the drill string section.

A first or second tool joint of the second drill string section may be connectable to a first or second tool joint of the first drill string section to connect the first and second drill string sections together.

The first drill string section may be located further downhole than the second drill string section. The first drill string section may be a lower drill string section. The second drill string section may be an upper drill string section.

A third or further drill string section may be connected to the second drill string section. The third or further drill string section may comprise a plurality of drill pipe members having first tool joint with a first tool joint outer diameter, a second tool joint having a second tool joint outer diameter; and a tubular body between the first and second tool joints having a tubular body outer diameter. The first tool joint outer diameter and second tool joint outer diameter of the third or further drill string may be larger than the tubular body outer diameter of the drill pipe member in the third or further drill string section.

Alternatively, the first tool joint outer diameter and the second tool joint outer diameter of the third or further drill string may be substantially the same diameter as the tubular body outer diameter in each drill pipe members. A third or further drill string section may have an outer diameter that is substantially uniform along its longitudinal length.

According to a second aspect of the invention, there is provided a managed pressure drilling system for use in managed pressure drilling operations, the system comprising:

a rotating sealing device; and a drill string comprising a plurality of drill pipe members wherein each drill pipe member has a first tool joint having a first tool joint outer diameter;

a second tool joint having a second tool joint outer diameter; and a tubular body between the first and second tool joints having a tubular body outer diameter;

wherein the first tool joint outer diameter, the second tool joint outer diameter and the tubular body outer diameter are substantially the same; and wherein the rotating sealing device is configured to form a fluid seal against the drill string.

The rotating sealing device may be configured to form a fluid seal against at least part of a drill pipe member of the drill string. The rotating sealing device may be configured to operate in annular wellbore fluid pressures in the range of 2000 psi to 10000 psi.

The rotating sealing device may be a rotary control device (RCD). The rotary control device may comprise at least one sealing element configured to form and maintain a fluid seal against at least one surface of the drill string. The at least one sealing element may be configured to form and maintain a fluid seal against at least one part of the drill string.

The drill string may be an upper drill string section. The drill string may be connectable to a lower drill string connected to a drill bit. The drill string may be configured to connected to a lower drill string. The lower drill string may be configured to be connected to a drill bit at one end.

The lower drill string may comprise a plurality of drill pipe members wherein each drill pipe member has a first tool joint having a first tool joint outer diameter;

a second tool joint having a second tool joint outer diameter; and a tubular body between the first and second tool joints having a tubular body outer diameter; wherein the first tool joint outer diameter and the second tool joint outer diameter of the lower drill string may be larger than the tubular body outer diameter.

Alternatively the first tool joint outer diameter and/or the second tool joint outer diameter may be smaller than the tubular body outer diameter in the lower drill string.

The drill string may be connectable to an upper drill string. The drill string may be configured to connected to an upper drill string. The upper drill string may be configured to be connected to the drill string at one end. The upper drill string may have a generally constant outer diameter along its longitudinal length. The outer diameter of the lower drill string along its longitudinal length may vary due to protrusions at the joint connections.

Embodiments of the second aspect of the invention may include one or more features of the first aspect of the invention or its embodiments, or vice versa.

According to a third aspect of the invention, there is provided a drill string assembly for managed pressure drilling comprising:

a plurality of drill pipe members arranged in a first drill string section and a second drill string section;

wherein each drill pipe member has a first tool joint having a first tool joint outer diameter;

a second tool joint having a second tool joint outer diameter;

a tubular body between the first and second tool joints having a tubular body diameter;

wherein the first tool joint outer diameter and second tool joint outer diameter of each drill pipe member in the second drill string section are substantially equal to the tubular body diameter in each drill pipe member in the second drill string section; and wherein the first tool joint outer diameter and/or second tool joint outer diameter of each drill pipe member in the first drill string section is larger than the tubular body diameter in each the drill pipe member in the first drill string section.

The first tool joint of the drill pipe members in the first and/or second drill string sections may be a box section and the second tool joint of the drill pipe members in the first and/or second drill string sections may be a pin section. Alternatively, the first tool joint may be a pin section and the second tool joint may be a box section.

The first tool joint and/or second tool joint in each drill pipe member in the first drill string section may have an upset. The upset may be an external and/or an internal upset.

The first tool joint and/or second tool joint in each drill pipe member in the second drill string section may have an internal upset.

The second drill string section may be configured to be substantially vertical. The second drill string section may be configured to be used in a substantially vertical section of a well. In an offshore managed pressure drilling operation the second drill string section may be contained within a riser such as a marine riser. In an onshore managed pressure drilling operation the second drill string section may be contained within an upper casing or liner.

The first drill string section may be configured to be located further downhole than the second drill string section. The first drill string section may be a lower drill string section. The second drill string section may be an upper drill string section. The first drill string section may be configured to be used in a substantially horizontal or deviated section of a well.

Embodiments of the third aspect of the invention may include one or more features of the first or second aspects of the invention or their embodiments, or vice versa.

According to a fourth aspect of the invention, there is provided a drill string assembly for managed pressure drilling comprising:

a plurality of drill pipe members wherein each drill pipe members has a first tool joint having a first tool joint outer diameter;

a second tool joint having a second tool joint outer diameter; and a tubular body between the first and second tool joints having a tubular body outer diameter;

wherein the first tool joint outer diameter and the second tool joint outer diameter are substantially equal to the tubular body outer diameter in each drill pipe member in the drill string or at least one section of the drill string, wherein the drill string or at least one section of the drill string has a substantially constant outer diameter along its length.

The drill string and/or drill pipe members may have a constant outer diameter without any protruding or irregular surfaces from tool joints or drill collars. The continuous outer surface diameter of the drill string along its longitudinal length may enable sealing elements in an RCD to maintain a robust effective seal around a portion of the drill string without an obstruction or damage to sealing elements in the RCD.

The drill string may comprise drill pipe members with a substantially constant outer diameter which may be moved and passed through a sealing element of an RCD, such as during a drilling operation, while the sealing element is under pressure. As there are no protruding or irregular surfaces from tool joints, upsets or drill collars, damage or wear to the interior sealing surface of the sealing element may be mitigated.

The drill string may be arranged into two or more sections. The drill string may comprise at least one section of the drill string having a first tool joint outer diameter, the second tool joint outer diameter and tubular body outer diameter which are substantially the same is an upper or second drill string section. The drill string may comprise a lower or first drill string section wherein the first tool joint outer diameter and/or the second tool joint outer diameter is larger than the tubular body outer diameter in each drill pipe member in the lower or first drill string section. The drill string may comprise a second or upper drill string section having a first tool joint outer diameter, the second tool joint outer diameter and tubular body outer diameter which are substantially the same.

Embodiments of the fourth aspect of the invention may include one or more features of the first to third aspects of the invention or their embodiments, or vice versa.

According to a fifth aspect of the invention, there is provided a managed pressure drilling system for use in managed pressure drilling operations, the system comprising:

a rotating sealing device; and a drill string comprising a plurality of drill pipe members arranged in at least a first drill string section and a second drill string section;

wherein each of drill pipe members has a tubular pipe body with connectors at either end thereof for connection to adjacent drill pipe members;

wherein the connectors and the tubular pipe body of the drill pipe member in the second drill string section have substantially the same outer diameter; and wherein the connectors of the drill pipe members in the first drill string section have an outer diameter which is larger than the outer diameter of the tubular pipe body of the drill pipe members in the first drill string section; and wherein the rotating sealing device is configured to form a fluid seal against an outer surface of at least part of the second drill string section.

The connectors may be tool joints. The connectors may be a box section at a first end of the drill pipe member and a pin section at a second end of the drill pipe member.

Embodiments of the fifth aspect of the invention may include one or more features of the first to fourth aspects of the invention or their embodiments, or vice versa.

According to a sixth aspect of the invention, there is provided a managed pressure drilling system for use in managed pressure drilling operations, the system comprising:

a rotating sealing device; and a drill string comprising a plurality of drill pipe members;

wherein each drill pipe member comprises;

a tubular body;

a pin section at a first end of the tubular body; and a box section at the second end of the tubular body;

wherein the pin section and box section are configured for coupling to an adjacent drill pipe member and wherein the outer diameters of the tubular body, pin section and box section are substantially the same; and the rotating sealing device is configured to form a fluid seal against the drill string passing through the rotating sealing device.

The drill string may be connected to a drill bit. The drill string may be arranged into at least a first drill string portion and a second drill string portion.

Preferably the drill string is an upper drill string which may be connectable to a lower drill string connected to a drill bit. The drill string may be an upper drill string which may be configured to be connected to a lower drill string. The lower drill string may be configured to be connected to a drill bit. The lower drill string may comprise a plurality of drill pipe members wherein each drill pipe members may comprise a tubular body, a pin section at a first end of the tubular body; and a box section at the second end of the tubular body. At least one of the pin section outer diameter or the box section outer diameter may be larger or smaller than the tubular body outer diameter in the lower drill string.

The rotating sealing device may be configured to engage with an outside surface of part of a drill pipe member of the upper drill string so that flow of fluid between the rotating sealing device and the drill pipe member of the upper drill string is substantially prevented.

The pin section connector at one end and box section connector at the other end of the drill pipe member are configured to mate with a corresponding connector on an adjacent drill pipe member to form a tool joint.

The upper drill string may be located within the substantially vertical section of the wellbore, riser, casing and/or liner. The lower drill string well bore may be located within the substantially non-vertical section of the wellbore, casing and/or liner.

The drill pipe members in the upper drill string may have a tool joints with diameters equal to the outer diameter of the tubular body of the drill pipe. The tubular body outer diameter may be flush or parallel with the outer diameter of the tool joints in the upper drill string.

The drill pipe members in the lower drill string may have a tubular body outer diameter less than the outer diameter of the tool joints of drill pipe over its length. The outer diameter of the drill pipe members in the lower drill string may have portions of enlarged diameter adjacent each end of the pipe joint having a diameter equal to the diameter of the external upset required for tool joints.

Embodiments of the sixth aspect of the invention may include one or more features of the first to fifth aspects of the invention or their embodiments, or vice versa.

According to a seventh aspect of the invention, there is provided a managed pressure drilling system for use in managed pressure drilling in a subsea well, the system comprising:

a riser;

a rotating sealing device; and a drill string comprising a plurality of drill pipe members;

wherein each drill pipe member comprises;

a tubular pipe body with connectors at either end thereof for connection to adjacent drill pipe members;

wherein the connectors and the tubular pipe body of the drill pipe member in the drill string have substantially the same outer diameter; and the rotating sealing device is configured to form a fluid seal between at least part of the drill string passing through the rotating sealing device and the riser.

The rotating sealing device may be configured to form a fluid seal between an outer surface of the drill string passing through the rotating sealing device and an inner surface of the riser.

The drill string may be an upper drill string section. The system may comprise a lower drill string. The drill string may be connectable to a lower drill string connected to a drill bit.

The lower drill string may comprise plurality of drill pipe members; wherein each drill pipe member in the lower drill string comprises a tubular pipe body with connectors at either end thereof for connection to adjacent drill pipe members wherein the connectors of the drill pipe members in the lower drill string have an outer diameter which is larger than the outer diameter of the tubular pipe body of the drill pipe members in the lower drill string.

The larger diameter connectors in the lower drill string may provide structural support to the connections between the drill pipe members in the lower drill string to provide flexibility as the lower drill string deviates from the vertical in the wellbore. The larger diameter connectors may also reduce or minimise mechanical or bending stresses acting on the connections of the lower drill string as it curves and deviates from the vertical.

Embodiments of the seventh aspect of the invention may include one or more features of the first to sixth aspects of the invention or their embodiments, or vice versa.

According to an eighth aspect of the invention, there is provided a managed pressure drilling system for use in managed pressure drilling in an onshore well, the system comprising:

an upper casing;

a rotating sealing device; and a drill string comprising a plurality of drill pipe members;

wherein each drill pipe member comprises;

a tubular pipe body with connectors at either end thereof for connection to adjacent drill pipe members;

wherein the connectors and the tubular pipe body of the drill pipe member in the drill string have substantially the same outer diameter; and the rotating sealing device is configured to form a fluid seal between at least part of the drill string passing through the rotating sealing device and the upper casing.

The rotating sealing device may be configured to form a fluid seal between at least part of an outer surface of the drill string passing through the rotating sealing device and an inner surface of the upper casing.

The drill string may be an upper drill string section. The system may comprise a lower drill string section. The drill string may be connectable to a lower drill string connected to a drill bit. The lower drill string may comprise a plurality of drill pipe members; wherein each drill pipe member in the lower drill string comprises a tubular pipe body with connectors at either end thereof for connection to adjacent drill pipe members wherein the connectors of the drill pipe members in the lower drill string have an outer diameter which is larger than the outer diameter of the tubular pipe body of the drill pipe members in the lower drill string.

The larger diameter connectors in the lower drill string may provide structural support to the connections between the drill pipe members to provide flexibility as the lower drill string deviates from the vertical in the wellbore. The larger diameter connectors may also reduce or minimise mechanical or bending stresses acting on the connections of the lower drill string as it curves and deviates from the vertical.

Embodiments of the eighth aspect of the invention may include one or more features of the first to seventh aspects of the invention or their embodiments, or vice versa. According to a ninth aspect of the invention, there is provided a method for managed pressure drilling, comprising the steps of:

providing a managed pressure drilling system, the system comprising:

a rotating sealing device; and a drill string comprising a plurality of drill pipe members;

wherein each drill pipe member comprises;

a tubular pipe body with connectors at either end thereof for connection to adjacent drill pipe members;

wherein the connectors and the tubular pipe body of the drill pipe member in the drill string have substantially the same outer diameter;

lowering the drill string into a tubular connected to a well;

forming a fluid seal between the drill string and the tubular;

passing at least a portion of the drill string through the rotating sealing device.

The method may comprise drilling the wellbore. The method may comprise drilling the wellbore at a pre-determined fluid annular pressure. The predetermined fluid annular pressure may be less than a casing shoe pressure and/or a formation fracture pressure.

The method may comprise forming a fluid seal between the drill string and the tubular by contacting at least one sealing element in the rotating sealing device with an outer surface of part of the drilling string.

The method may comprise connecting the drill string and/or one or more drill pipe members to a lower drill string. The lower drill string may be configured to be connected to or may be connected to a drill bit.

The drill string may be arranged into an upper drill string portion and a lower drill string portion. The connectors and the tubular pipe body of the drill pipe member in the upper drill string may have substantially the same outer diameter. The connectors and the tubular pipe body of the drill pipe member in the upper drill string may have different outer diameters.

The lower drill string may be connected to a bottom hole assembly. The lower drill string may comprise a plurality of drill pipe members; wherein each drill pipe member in the lower drill string comprises a tubular pipe body with connectors at either end thereof for connection to adjacent drill pipe members wherein the connectors of the drill pipe members in the lower drill string have an outer diameter which is larger than the outer diameter of the tubular pipe body of the drill pipe members in the lower drill string.

The method may be used for onshore or offshore drilling. The tubular may be a riser, casing and/or liner. The method may comprise deviating the lower drill string from the vertical. The method may comprise maintaining the upper drill string substantially vertical.

The method may comprise locating and/or maintaining the drill string in a substantial vertical section of the tubular and/or well. The method may comprise locating the lower drill string in a substantial non-vertical section of the wellbore.

Embodiments of the ninth aspect of the invention may include one or more features of the first to eighth aspects of the invention or their embodiments, or vice versa.

According to a tenth aspect of the invention, there is provided a method for managed pressure drilling in a subsea well, comprising:

providing a managed pressure drilling system, the system comprising:

a riser;

a rotating sealing device;

a drill string comprising a plurality of drill pipe members arranged in a first drill string section and a second drill string section;

wherein the drill pipe members of the second drill string section are flush joint drill pipe members having an equal outer diameter along its length; and wherein the drill pipe members of the first drill string section have tool joints at each end of a tubular body which have an outer diameter greater than the tubular body outer diameter;

lowering the drill string into the riser;

forming a fluid seal between the riser and an outer surface of the second drill string section; and passing at least a portion of the section drill string through the rotating sealing device; and drilling the wellbore.

The method may comprise drilling the wellbore at a pre-determined fluid annular pressure. The method may comprise connecting a drill bit to the first drill string section.

The method may comprise locating and/or maintaining the second drill string section in a substantial vertical section of the riser. The method may comprise locating the first drill string section in a substantial non-vertical section of the wellbore.

Embodiments of the tenth aspect of the invention may include one or more features of the first to ninth aspects of the invention or their embodiments, or vice versa.

According to an eleventh aspect of the invention, there is provided a method for managed pressure drilling in a well, comprising:

providing a managed pressure drilling system, the system comprising:

an upper casing;

a rotating sealing device;

a drill string comprising a plurality of drill pipe members arranged in a first drill string section and a second drill string section;

wherein the drill pipe members of the second drill string section are flush joint drill pipe members having an equal outer diameter along its length; and wherein the drill pipe members of the first drill string section have tool joints at each end of a tubular body which have an outer diameter greater than the tubular body outer diameter; lowering the drill string into the casing;

forming a fluid seal between the casing and an outer surface of the second drill string section; and passing at least a portion of the second drill string section through the rotating sealing device; and drilling the wellbore.

The method may comprise drilling the wellbore at a pre-determined fluid annular pressure. The well may be an onshore or offshore well. The method may comprise locating and/or maintaining the second drill string in a substantial vertical section of the casing, liner and/or well. The method may comprise locating and/or maintaining the first drill string in a substantial non-vertical section of the wellbore.

The first drill section may be a lower drill string section connected to a drill bit. The second drill string section may be an upper drill string section.

Embodiments of the eleventh aspect of the invention may include one or more features of the first to tenth aspects of the invention or their embodiments, or vice versa.

According to a twelfth aspect of the invention, there is provided a method for drilling a well, comprising:

providing a drilling system, the system comprising:

a rotating sealing device; and a drill string comprising a plurality of drill pipe members arranged in a first drill string section;

wherein each drill pipe member comprises a tubular pipe body with connectors at either end thereof for connection to adjacent drill pipe members;

drilling a first section of the well using the first drill string section comprising a plurality of first drill pipe members with connectors larger than the outer diameter of the tubular pipe body;

connecting a second drill string section to the first drill string section wherein the connectors and the tubular pipe body of the plurality of drill pipe members in the second drill string section have substantially the same outer diameter;

forming a fluid seal between a tubular connected in the well and a part of the outer surface of the second drill string section; and passing at least a portion of the second drill string through the rotating sealing device; and drilling a second section of the well.

The method may comprise drilling a second section of the well at a pre-determined fluid annular pressure. The method may comprise installing or connecting the tubular to the first section of the well. The tubular may be a riser, casing and/or liner. The method may comprise drilling the first section of the well using conventional well control drilling. The method may comprise drilling the second section of the well by using managed pressure drilling.

The method may comprise drilling a third section of the well by using conventional well control drilling. The method may comprise drilling a third section of the well by connecting a third drill string section to an upper portion of the second drill string section. The outer diameter of the connectors of the drill pipe members in the third drill string section may be larger or different than the outer diameter of the tubular pipe body of the drill pipe members in the third drill string section. The method may comprise removing or deactivating the seal and/or the rotating sealing device before drilling the third section of the well.

The method may comprise drilling one or more further sections of the well using managed pressure drilling by reforming or reactivating the seal and/or reinstalling the RCD and connecting a further drill string section to the drill string wherein the connectors and the tubular pipe body of the plurality of drill pipe members in the further drill string have substantially the same outer diameter. The method may comprise passing at least a portion of the further drill string through the rotating sealing device; and drilling the further section of the well at a pre-determined fluid annular pressure.

The method may comprise alternating between conventional drilling and managed pressure drilling to drill further sections of the well. When managed pressure drilling is required the uppermost section of drill string may comprise parallel drill pipe with a continuous outer surface diameter along its longitudinal length of the drill string section to allow an effective seal to be maintained with the RCD as the drill pipe is moved downhole or raised uphole. The continuous outer surface diameter of the parallel drill string mitigates wear on sealing elements in the RCD.

The method may comprise drilling at a deviated angle to the horizontal.

Embodiments of the twelfth aspect of the invention may include one or more features of the first to eleventh aspects of the invention or their embodiments, or vice versa.

According to a thirteenth aspect of the invention, there is provided a method for raising or lowering a drill string in well, comprising:

providing a drilling system, the system comprising:

a rotating sealing device; and a drill string comprising a plurality of drill pipe members wherein each drill pipe member has a first tool joint having a first tool joint outer diameter;

a second tool joint having a second tool joint outer diameter; and a tubular body between the first and second tool joints having a tubular body outer diameter;

wherein at least one section of the drill string has a first tool joint outer diameter, the second tool joint outer diameter and the tubular body outer diameter are substantially the same; and wherein the rotating sealing device is configured to form a fluid seal against at least part of the at least one section of the drill string;

lowering or raising the at least one section of the drill string in the well through the rotating sealing device.

Embodiments of the thirteenth aspect of the invention may include one or more features of the first to twelfth aspects of the invention or their embodiments, or vice versa.

According to a fourteenth aspect of the invention, there is provided a drill string assembly for managed pressure drilling the drill string comprising:

a plurality of drill pipe members wherein each drill pipe members has a first tool joint having a first tool joint outer diameter;

a second tool joint having a second tool joint outer diameter; and a tubular body between the first and second tool joints having a tubular body outer diameter;

wherein each drill pipe members in at least one section of the drill string has a first tool joint outer diameter and a second tool joint outer diameter which are substantially equal to the tubular body outer diameter wherein in at least one section of the drill string has a substantially constant outer diameter along its length.

The at least one section of the drill string may be a section of the drill string located at a uphole end of the drill string section. The at least one section of the drill string may be a section of the drill string located closest to the surface or closest to the top of a riser.

The at least one section of the drill string may be a located above a lower section of drill string. The lower section of drill string may be configured to be connected to or may be connected to a drill bit. The at least one section of the drill string may be configured to connected to the lower drill string.

The lower drill string may comprise a plurality of drill pipe members wherein each drill pipe member has a first tool joint having a first tool joint outer diameter; a second tool joint having a second tool joint outer diameter; and a tubular body between the first and second tool joints having a tubular body outer diameter; wherein the first tool joint outer diameter and the second tool joint outer diameter may be larger than or different to the tubular body outer diameter.

Embodiments of the fourteenth aspect of the invention may include one or more features of the first to thirteenth aspects of the invention or their embodiments, or vice versa.

According to a fifteenth aspect of the invention, there is provided a managed pressure drilling system comprising:

a rotating sealing device; and a drill string comprising a plurality of drill pipe members wherein each drill pipe member has a first tool joint having a first tool joint outer diameter;

a second tool joint having a second tool joint outer diameter; and a tubular body between the first and second tool joints having a tubular body outer diameter;

wherein in at least one section of the drill string the first tool joint outer diameter, the second tool joint outer diameter and the tubular body outer diameter are substantially the same; and wherein the rotating sealing device is configured to form a fluid seal against at least a part of the at least one section of drill string.

The at least one section of the drill string may have an outer diameter that is substantially uniform along its longitudinal length.

The drill string may be arranged into two or more sections wherein the at least one section of the drill string having a first tool joint outer diameter, the second tool joint outer diameter and tubular body outer diameter which may be substantially the same may be an upper drill string section. The drill string may comprise a lower drill string section wherein the first tool joint outer diameter and/or the second tool joint outer diameter may be larger than or different to the tubular body outer diameter in each drill pipe member in the lower drill string section.

Embodiments of the fifteenth aspect of the invention may include one or more features of the first to fourteenth aspects of the invention or their embodiments, or vice versa.

According to a sixteenth aspect of the invention, there is provided a method for drilling a well, the method comprising:

providing a drilling system, the system comprising:

a rotating sealing device; and a plurality of drill pipe members comprising first drill pipe members and second drill pipe members;

wherein each drill pipe member comprises a tubular pipe body with connector joints at either end thereof;

wherein first drill pipe members have connector joint outer diameters which are larger than the outer diameter of the tubular pipe body;

wherein second drill pipe members have connector joint outer diameters which are substantially the same as the outer diameter of the tubular pipe body;

wherein the first drill pipe members are configured to be connected to form a first drill string section and the second drill pipe members are configured to be connected to form a second drill string section;

drilling a first section of the well using the first drill string section comprising a plurality of first drill pipe members;

connecting second drill pipe members to the first drill string section;

forming a fluid seal between a tubular connected in the well and an outer surface of at least part of a second drill pipe member in the second drill string section;

passing at least part of the second drill string through the rotating sealing device; and drilling a second section of the well at a pre-determined fluid annular pressure.

The method may comprise drilling a first section of the well using conventional drilling and drilling the second section of the well using managed pressure drilling. The method may comprise drilling a third section of the well using conventional drilling or managed pressure drilling.

The method may comprise drilling a third section of the well by connecting a plurality of third drill pipe members to an upper portion of the second drill string section.

The third section of the well may be drilled using conventional drilling wherein the rotating sealing device is removed or deactivated and the third drill pipe members in third drill string section comprise connector joints which are larger than the outer diameter of the tubular pipe body of the third drill pipe members in the third drill string section.

Embodiments of the sixteenth aspect of the invention may include one or more features of the first to fifteenth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
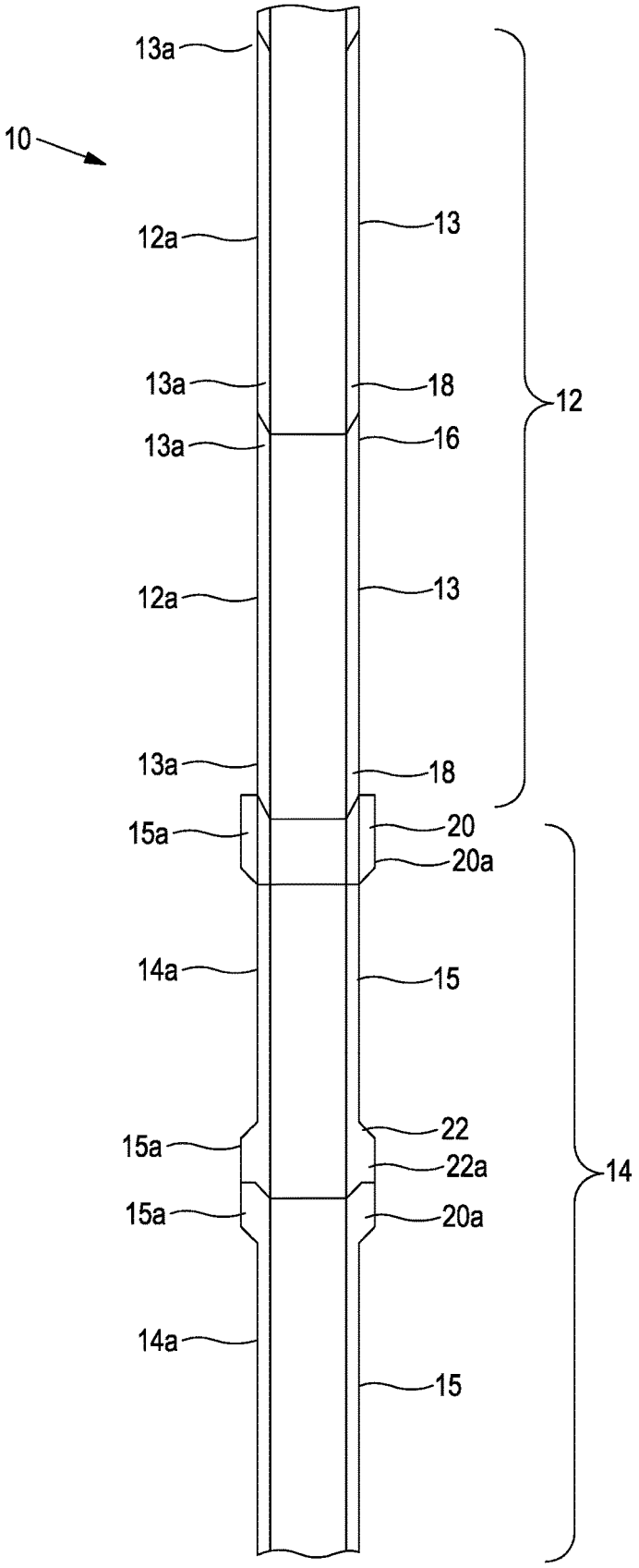
FIG. 1A is a sectional side view of a drill pipe assembly according to an embodiment of the invention.
Figure 1B:
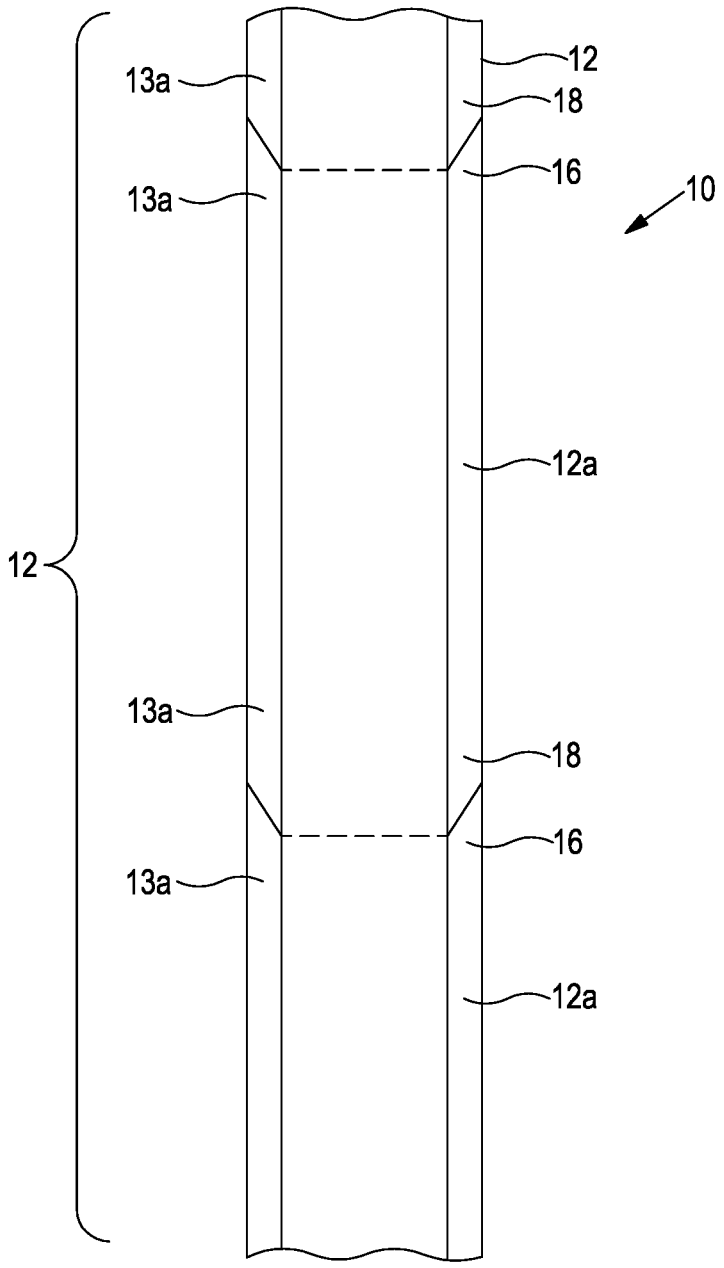
FIG. 1B is an enlarged sectional side view of part of an upper drill string portion of the drill pipe assembly of FIG. 1A.
Figure 1C:
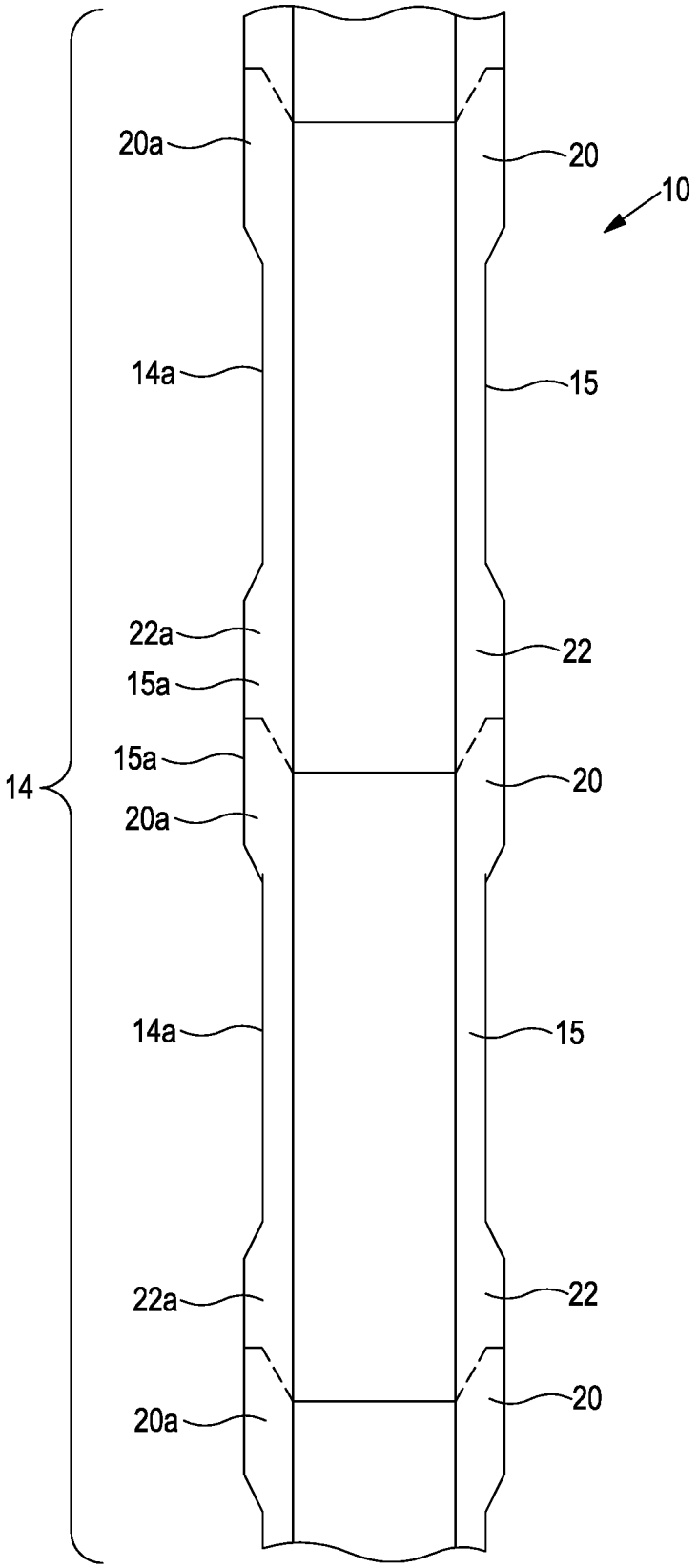
FIG. 1C is an enlarged sectional side view of part of a lower drill string portion of the drill pipe assembly of FIG. 1A.

Referring firstly to FIGS. 1A, 1B and 10 there is represented a drill string apparatus for managed pressure drilling generally depicted at 10. The drill string apparatus 10 comprises an upper drill string portion 12 and a lower drill string portion 14. The upper drill string portion 12 comprises a plurality of drill pipe members 12*a* that are connected in an end-to-end relationship. The lower drill string portion 14 comprises a plurality of drill pipe members 14*a* that are connected in an end-to-end relationship.

In use the lower drill string portion 14 is located closest to the bottom hole assembly drill bit (not shown). The upper drill string portion 12 is positioned closest to the surface so that it engages a rotary seal member discussed further in FIGS. 2, 3 and 4A to 4C below.

As best shown in FIGS. 1A and 1B, each of the drill pipe members 12*a* in the upper drill string portion 12 has a tubular central body 13 with tool joints 13*a* at each end. The tool joints are connectors also known as connector joints which connect the drill pipe members to one another. In this example the tool joints 13*a* are a box section 16 at a first end of the tubular body and a pin section 18 at a second end of the tubular body 13. The box section 16 is designed to connect to a pin section 18 of an adjacent drill pipe member such as by threadedly coupling. Similarly, the pin section 18 is designed to connect to the box section of an adjacent drill pipe member. The tool joints 13*a* and the tubular pipe body 13 of the upper drill pipe members 12 have substantially the same outer diameter (OD). The tool joints 13*a* are flush with the tubular central body 13 of the drill pipe members 12*a* in the upper drill string portion 12.

As best shown in FIGS. 1A and 10, each of the drill pipe members 14*a* in the lower drill string portion 14 has a tubular central body 15 with tool joints 15*a* at each end. In this example the tool joints 15*a* are a box section 20 at a first end of the tubular central body and a pin section 22 at a second end of the tubular central body 15. The box section 20 is designed to threadedly couple to the pin section of an adjacent drill pipe member to form a drill string. Similarly, the pin section 22 is designed to threadedly couple to the box section 20 of an adjacent drill pipe member.

The box section 20 has an external upset 20*a* formed as a radially flared extension of the body section 15. The upset 20*a* provides structural support to the box section 20 when threaded coupled to a pin section 22 of an adjacent drill pipe member. Similarly, the pin section 22 has an external upset 22*a* formed as a radially flared extension of the body section 15 which provides structural support to the box section 22 when threaded coupled to a box section 20 of an adjacent drill pipe member 14*a*.

The outer diameter of the tool joints 15*a* and upsets 20*a*, 22*a* is larger than the outer diameter of the tubular central pipe body 15 of the lower drill pipe members 14*a*.

As shown in FIG. 1A, a pin section 18 of the upper drill string 12 connects to a box section 20 of the lower drill string to connect the upper and lower drill strings. However, it will be appreciated that the pin and box section arrangements may be reversed and a box section of the upper drill string may be connected to a pin section of the lower drill sting.

Although in the above examples the connectors (tool joints) which couple the drill pipe members are pin and box type connectors, it will be appreciated that other connection types may be used.

It will be appreciated that the tool joint 13*a* of the upper drill string portion may have internal upsets to provide structural support to the connectors between the drill pipe members 12*a* without affecting the flush outer diameter.

Figure 2:
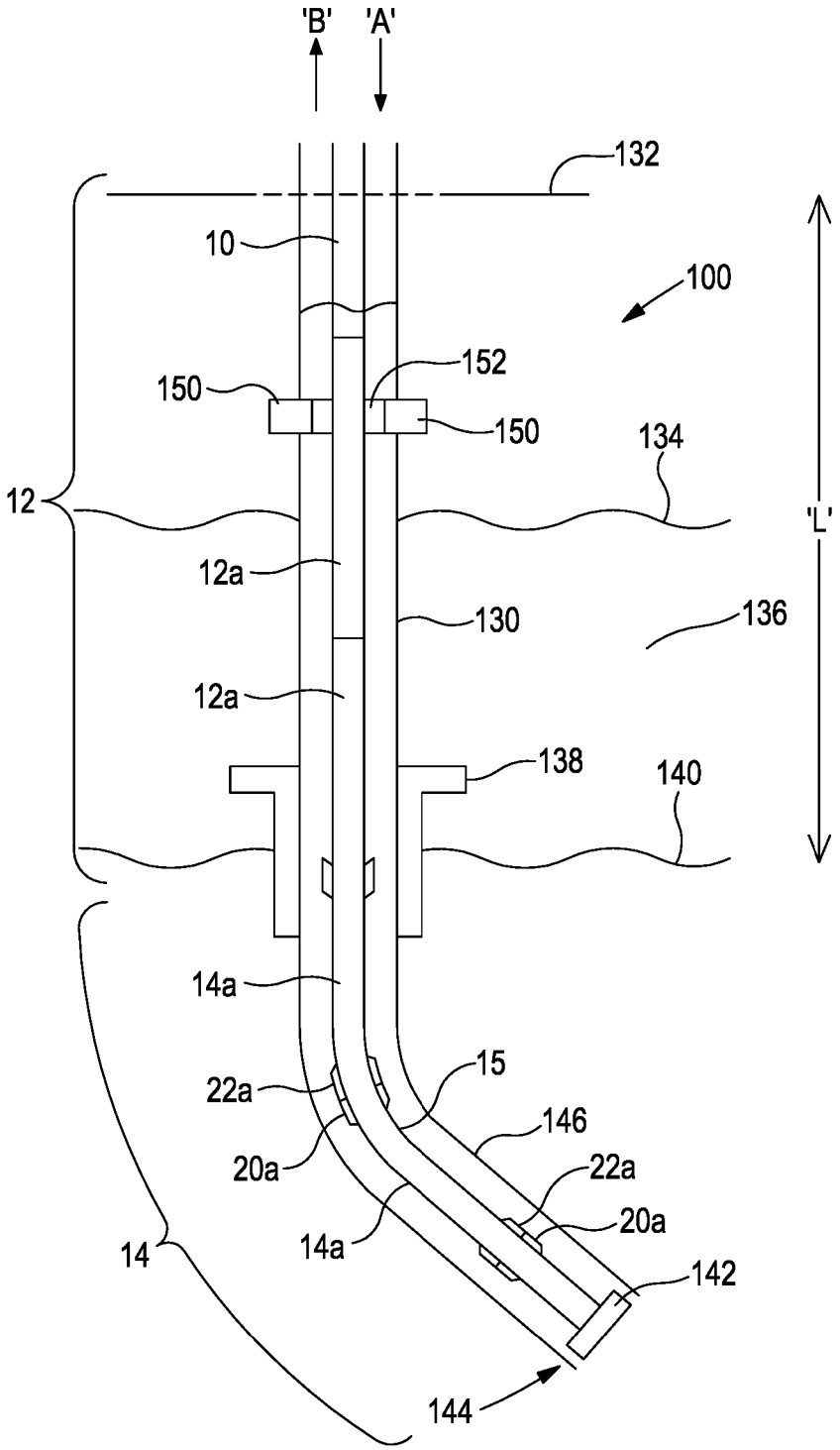
FIG. 2 is a schematic representation of a managed pressure drilling system for offshore managed pressure drilling in a deviated well according to an embodiment of the invention with the managed pressure drilling components omitted for clarity.

FIG. 2 shows an offshore managed pressure drilling system 100 comprising the drill pipe assembly 10. The system 100 comprises a marine riser 130 suspended from a floating drilling vessel 132. The drilling vessel is positioned at the surface 134 of a body of water 136 above a subsea wellhead 138 located on the seabed 140. The vessel 132 will normally be equipped with a derrick, rotary table and other conventional drilling equipment (not shown).

The riser 130 extends from the vessel 132, through the body of water 136, and connects to the wellhead 138. The riser 130 forms a conduit between the vessel 132 and the wellhead 138. The marine riser 130 is configured for conveying the drill pipe assembly 10 and drilling fluids. Riser equipment and components such as auxiliary lines, kill and choke lines are not shown for clarity. The riser allows return of the drilling mud with drill cuttings from the hole that is being drilled and acts as a guide for the upper drill string portion 12.

A rotating control device (RCD) 150 is connected to the riser at an upper end of the riser 130, such as by a flanged connection. The RCD is configured to seal against drill pipe members 12*a* in the upper drill string portion 12 to create a pressure-tight barrier.

As shown in the FIG. 2, the upper drill string portion 12 is located in the generally vertical riser and the lower drill string portion 14 is located in the wellbore below or adjacent to the wellhead.

The RCD 150 comprises at least one elastomeric sealing element 152 which rotates as the drill pipe member 12*a* rotates and is flexible enough to accommodate and allow the flush drill pipe members in the upper drill string portion 12 to pass through the sealing element 152 without damaging the sealing element. The at least one elastomeric sealing element 152 in the RCD maintains a tight seal with drill pipe members 12*a* in the upper drill string portion such that returning fluids in the annulus are contained in the riser 130 below the RCD 150 as the flush drill pipe members 12*a* in the upper drill string portion pass through the RCD in a downhole or uphole direction.

By maintaining an effective seal with the drill pipe members 12*a* any flow of fluid between the at least one sealing element 152 and the drill pipe members 12*a* is substantially prevented.

During a subsea drilling operation as the drill bit 142 penetrates deeper into the earth, the flush upper drill string 12 is vertically lowered (arrow "A") or raised (arrow "B") in the riser and passes through the rotating control device.

As the upper drill string portion 12 has the same outer diameter throughout its length "L" an effective seal can be maintained between the outer surface of the drill pipe members 12*a* in the upper drill string portion 12 and the sealing elements 150. As the tool joints 13*a* in each drill pipe member 12*a* in the upper drill string portion 12 are flush with the main tubular body 13 in the upper drill string portion the upper drill string portion 12 can pass through the RCD 150 without resulting in friction, drag or wear on the at least one sealing element 152.

As the bottom hole assembly 144 including drill bit 142 drills deeper and deviates from the vertical as shown in FIG.

2, the lower drill string 14 follows an angled or curved path that deviates anywhere from a few degrees off the vertical axis to a substantially horizontal axis.

Each of the drill pipe members 14*a* in the lower drill string portion 14 has tool joints 15*a* which have external upsets 20*a*, 22*a*. The external upsets 20*a*, 22*a* have an outer diameter larger than the main tubular body 15 of the drill members in the lower drill string portion. The larger diameter external upsets 20*a*, 22*a* provide the tool joints 15*a* at the ends of the drill pipe members 14*a* with an increased thickness which provides a larger and stronger connection between the drill pipe members 14*a*. This may mitigate mechanical stresses acting on the lower drill string portion 14 preventing fatigue failure as the lower drill string portion 14 deviates from the vertical during drilling in deviated or horizontal wells.

The external upsets 20*a*, 22*a* of the tool joints 15*a* may distance the main tubular body 15 of the drill pipe members 14*a* from the wellbore 146 and protect the main tubular body 15 from contact with the wellbore 146. This may prevent wear and damage of the main tubular body. Furthermore by providing upsets 20*a*, 22*a* which distance the main tubular body 15 from the well bore 146, frictional and torsional forces which may resist the rotation of the drill string during drilling may be mitigated.

Figure 3:
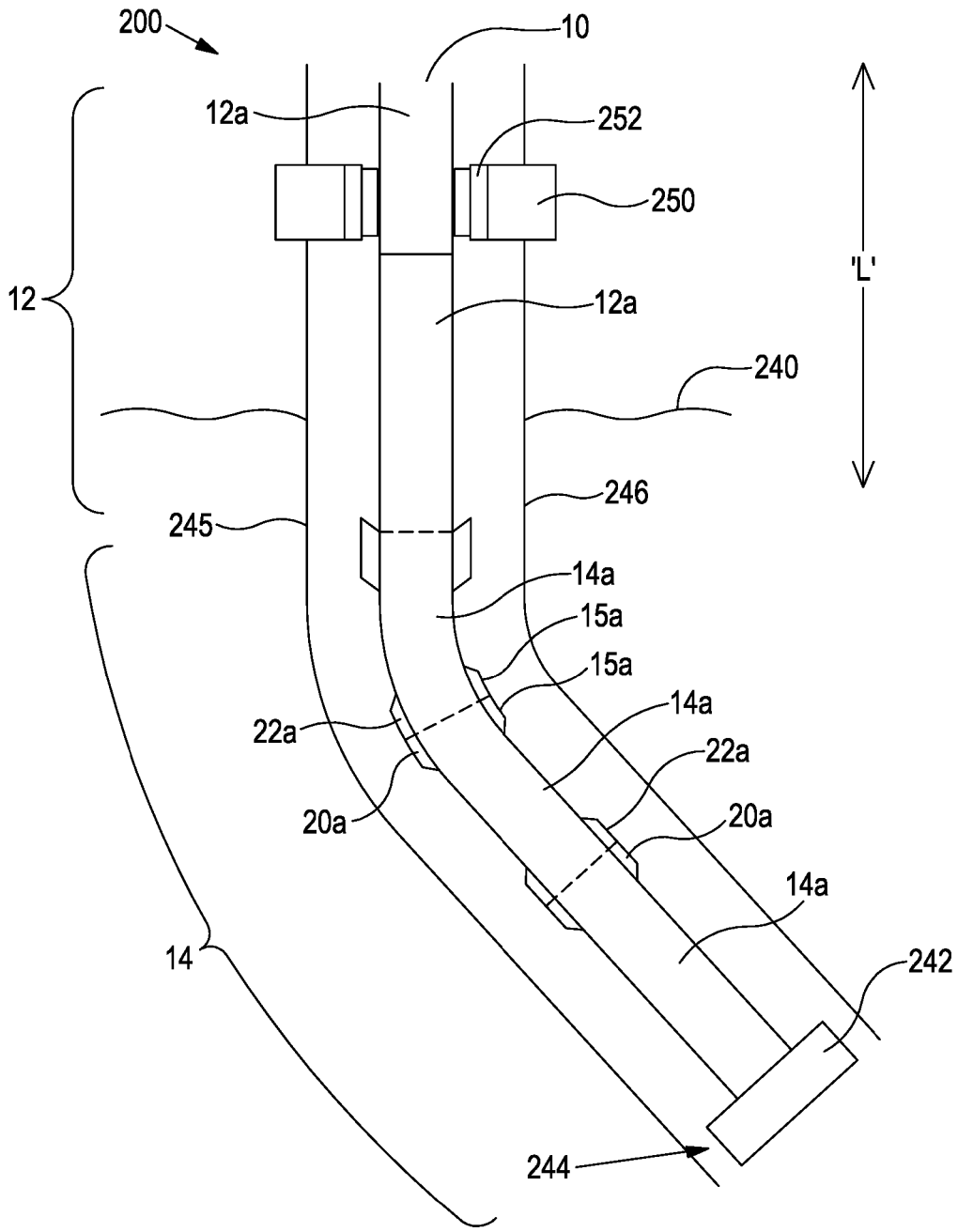
FIG. 3 is a schematic representation of a managed pressure drilling system for onshore managed pressure drilling in a deviated well according to an embodiment of the invention with the managed pressure drilling components omitted for clarity.

FIG. 3 shows an onshore managed pressure drilling system 200 which uses the drill pipe assembly 10. The system 200 is similar to the operation of the system 100 described above in relation to FIG. 2. The onshore managed pressure drilling system 200 will be understood from FIG. 2 and its description above. However the system 200 is onshore and uses a casing 245 in the well 246 to contain the upper drill string portion instead of marine riser.

A riser is therefore not required in system 200, instead a casing 245 in the wellbore 246 contains the upper drill string section or portion 12 instead of marine riser. An RCD 250 is connected to the casing and is configured to seal against drill pipe members 12*a* in the upper drill string section or portion 12 to create a pressure-tight barrier. As the upper drill string portion 12 has the same outer diameter throughout its length "L" an effective seal can be maintained between the outer surface of the drill pipe members 12*a* in the upper drill string portion 12 and the sealing elements 252 of the RCD 250. As the tool joints 13*a* in each drill pipe member 12*a* in the upper drill string portion 12 are flush with the main tubular body 13 in the upper drill string portion the upper drill string portion 12 can pass through the RCD 250 without resulting in friction, drag or wear on the at least on rotating sealing element 252.

As the bottom hole assembly 244 including drill bit 242 drills deeper and deviates from the vertical as shown in FIG. 3, the lower drill string 14 follows an angled or curved path that deviates anywhere from a few degrees off the vertical axis to a substantially horizontal axis.

Each of the drill pipe members 14*a* in the lower drill string portion 14 has tool joints 15*a* which have external upsets 20*a*, 22*a*. The external upsets 20*a*, 22*a* have an outer diameter larger than the main tubular body 15 of the drill members in the lower drill string portion. The larger diameter external upsets 20*a*, 22*a* provide the tool joints 15*a* at the ends of the drill pipe members 14*a* with an increased thickness which provides a larger, stronger and stiffer connection between the drill pipe members 14*a*. This mitigates mechanical stresses acting on the lower drill string portion 14 preventing fatigue failure as the lower drill string portion 14 deviates from the vertical during drilling in deviated or horizontal wells. The external upsets 20*a*, 22*a* of the tool joints 15*a* distance the main tubular body 15 of the drill pipe members 14*a* from the wellbore 246 and protects the main tubular body 15 from contact with the wellbore 246. This prevents wear and damage of the main tubular body. Furthermore by providing upsets 20*a*, 22*a* which distance the main tubular body 15 from the well bore 246, frictional and torsional forces which may resist the rotation of the drill string during drilling are mitigated.

Figure 4A:
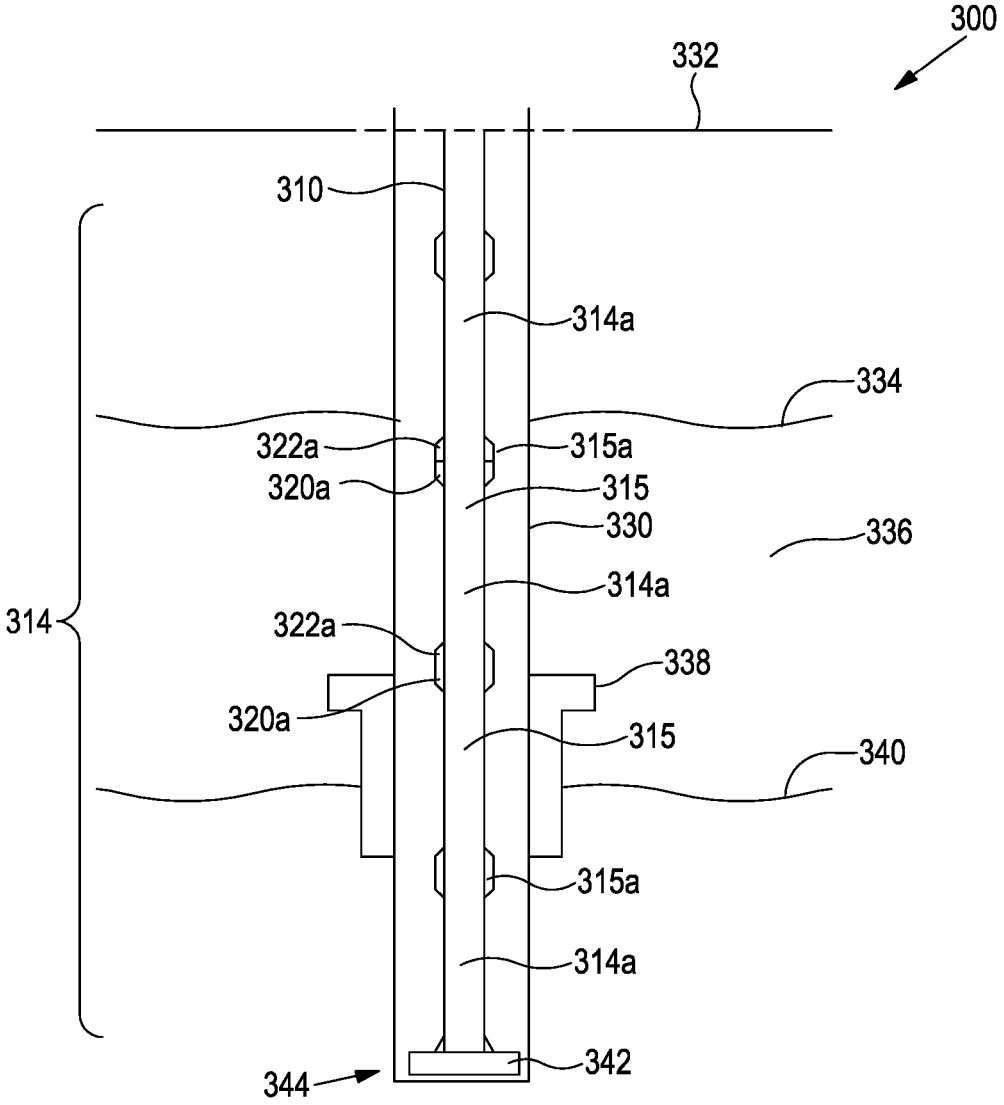
FIGS. 4A, 4B and 4C are schematic representations of stages of drilling a deviated well using conventional and managed pressure drilling operations according to an embodiment of the invention.
Figure 4B:
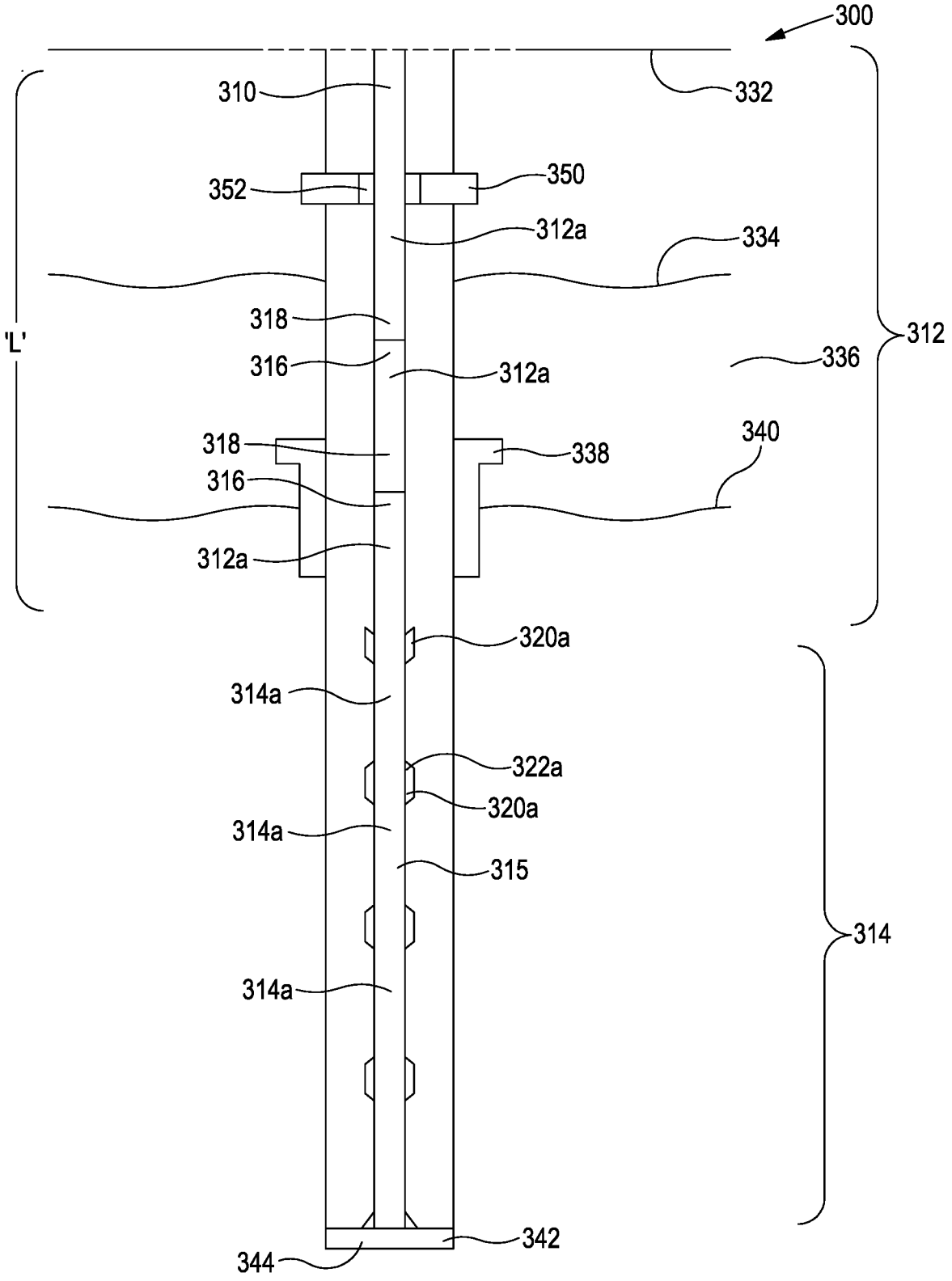
Figure 4C:
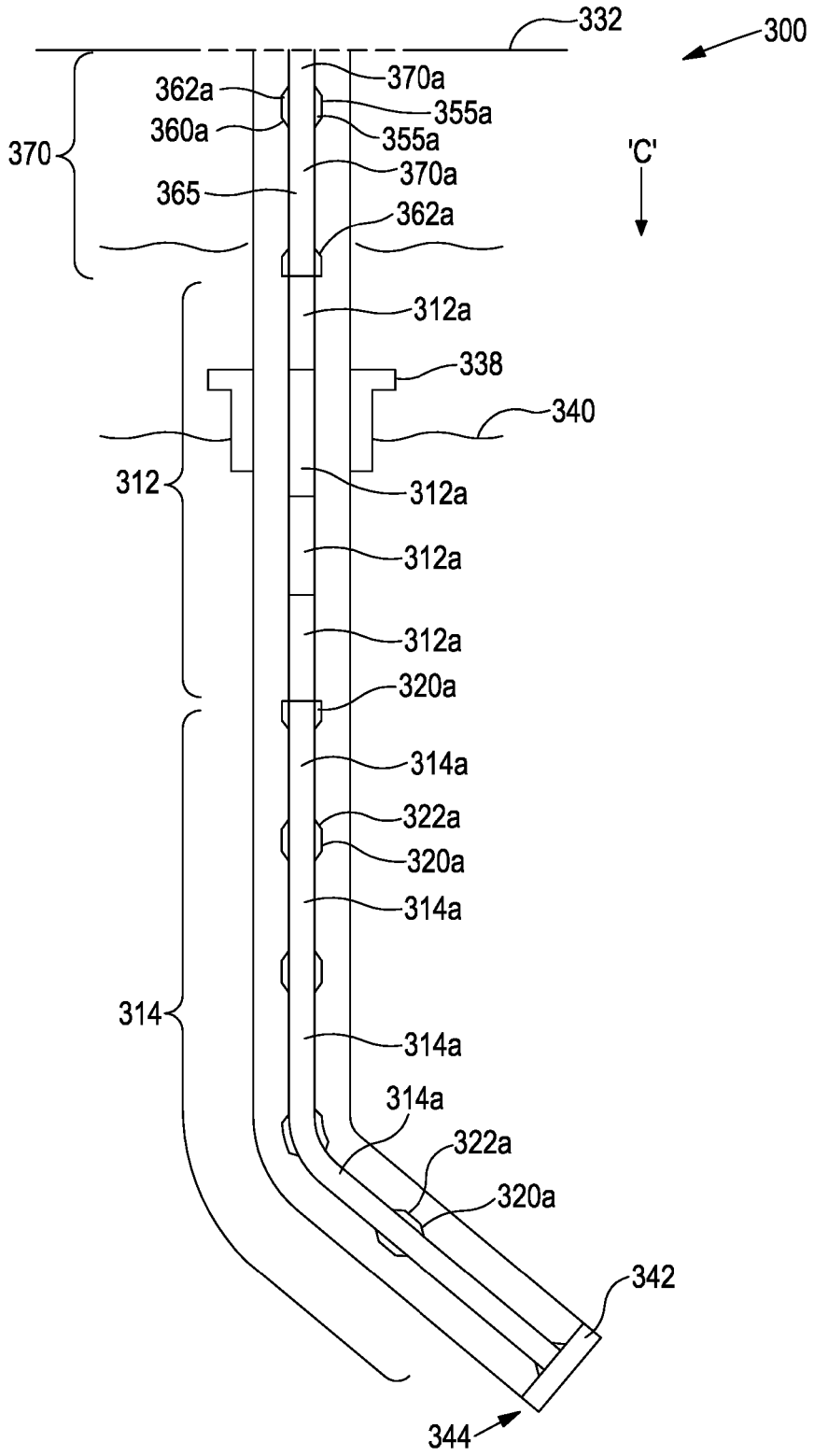

FIGS. 4A, 4B and 4C show stages of drilling an offshore well. The system 300 comprises a marine riser 330 suspended from a floating drilling vessel 332. The drilling vessel is positioned at the surface 334 of a body of water 336 above a subsea wellhead 338 located on the seabed 340.

The vessel 332 will normally be equipped with a derrick, rotary table and other conventional drilling equipment (not shown).

The riser 330 extends from the vessel 332, through the body of water 336, and connects to the wellhead 338. The riser 330 forms a conduit between the vessel 332 and the wellhead 338. The marine riser 330 is configured for conveying the drill pipe assembly 310 and drilling fluids. Riser equipment and components such as auxiliary lines, kill and choke lines are not shown for clarity. The riser 330 allows return of the drilling mud with drill cuttings from the hole that is being drilled and acts as a guide for the drill string 310. FIG. 4A shows the conventional drilling of a first section of a well. A first section of drill string 310 is lowered into the riser. In this example the first drill string section is made of conventional drill pipe members. Each of the drill pipe members 314*a* in the first drill string section 314 has tool joints 315*a* which have external upsets 320*a*, 322*a*. The external upsets 320*a*, 322*a* have an outer diameter larger than the main tubular body 315 of the drill members in the first drill string section.

The larger diameter external upsets 320*a*, 322*a* provide the tool joints 315*a* at the ends of the drill pipe members 314*a* with an increased thickness which provides a larger and stronger connection between the drill pipe members 314*a*. This mitigates mechanical stresses acting on the first drill string portion 314 preventing fatigue failure as the first drill string portion 314 deviates from the vertical during drilling in deviated or horizontal wells.

The conventional drilling method use drilling fluids open to atmospheric pressure to create an equivalent circulating density (ECD) that results in a bottom hole pressure (BHP) greater than pore pressure but less than the fracture initiation pressure of the formation being penetrated.

When the well reservoir pore pressure and the fracture pressure is reduced to a narrow window it is necessary to continue drilling using Managed pressure drilling (MPD) as shown in FIG. 4B, to maintain a downhole pressure that prevents the flow of formation fluids into the wellbore while keeping pressure well below the fracture initiation pressure.

In order to perform managed pressure drilling the annulus between the drill string and the riser is sealed by a rotating control device (RCD) 350. A drill pipe member 312*a* with flush tool joints 313*a* is connected to the first section (lower) of the drill sting 314. Further drill pipe member 312*a* with flush tool joints 313*a* are connected end to end to form a second drill sting section 312.

Each of the drill pipe members 312*a* in the second (upper) drill string section 312 has a tubular central body 313 with tool joints 313*a* at each end. In this example the tool joints 313*a* are a box section 316 at a first end of the tubular body and a pin section 318 at a second end of the tubular body 313. The box section 316 is designed to connect to a pin section 318 of an adjacent drill pipe member. Similarly, the pin section 318 is designed to connect to the box section of an adjacent drill pipe member.

The tool joints 313*a* and the tubular pipe body of the drill pipe members 312*a* in the second drill string section 312 have substantially the same outer diameter (OD). The tool joints 313*a* are flush with the tubular central body 313 of the drill pipe members 312*a* in the second drill string portion 312. The box section 316 and pin section 318 have internal upsets to provide strength to the tool joints 313*a*.

The RCD 350 is connected to the riser 330 at an upper end of the riser, such as by a flanged connection. The RCD is configured to seal against at least a part of a drill pipe member 312*a* in the second drill string section 312 to create a pressure-tight barrier.

The RCD 350 comprises a least one elastomeric sealing element 352 which rotates as the drill pipe member 312*a* rotates and is flexible enough to accommodate and allow the flush drill pipe members in the second drill string portion 312 to pass through the sealing element 352 without damaging the at least one sealing element 352. The at least one elastomeric sealing element 352 in the RCD maintains a tight seal with drill pipe members 312*a* in the second string section or portion such that returning fluids in the annulus are contained in the riser 330 below the RCD 350 as the flush drill pipe members 312*a* in the second drill string section or portion pass through the RCD.

As the second drill string section or portion 312 has the same outer diameter throughout its length "L" an effective seal can be maintained between an outer surface of the drill pipe members 312*a* in the second drill string portion 312 and the sealing elements 350. As the tool joints 313*a* in each drill pipe member 312*a* in the second drill string portion 312 are flush with the main tubular body 313 in the upper drill string portion the second string portion 312 can pass through the RCD 350 without resulting in friction, drag or wear on the at least on rotating sealing element 352.

Each of the drill pipe members 314*a* in the first drill string portion 314 has tool joints 315*a* which have external upsets 320*a*, 322*a*. The external upsets 320*a*, 322*a* have an outer diameter larger than the main tubular body 315 of the drill members in the first drill string portion. The larger diameter external upsets 320*a*, 322*a* provide the tool joints 315*a* at the ends of the drill pipe members 314*a* with an increased thickness which provides a larger and stronger connection between the drill pipe members 314*a*. This mitigates mechanical stresses acting on the first drill string portion 314 preventing fatigue failure as the first drill string portion 314 deviates from the vertical during drilling in deviated or horizontal wells.

The external upsets 320*a*, 322*a* of the tool joints 315*a* distance the main tubular body 315 of the drill pipe members 314*a* from the wellbore 346 and protects the main tubular body 350 from contact with the wellbore 346. This prevents wear and damage of the main tubular body. Furthermore by providing upsets 320*a*, 322*a* which distance the main tubular body 315 from the well bore 346, frictional and torsional forces which may resist the rotation of the drill string during drilling are mitigated.

Once MPD is no longer required, drilling may optionally be switched back to conventional well control drilling as shown in FIG. 4C by removing or deactivating the RCD 350. When managed pressure drilling operations are not required the RCD may be removed by decoupling and/or unlatching from the riser or deactivated such that no seal is formed with the drill string. As there is no longer a requirement to seal the annulus between the drill string and the riser, conventional drill pipe members 370*a* may be connected above the second drill string section 312 to form a third string section 370.

Each of the drill pipe members 370*a* in the third drill string 370 has tool joints 355*a* which have external upsets 360*a*, 362*a*. The external upsets 360*a*, 362*a* have an outer diameter larger than the main tubular body 365 of the drill members 370*a* in the drill string. As the drill bit 342 penetrates deeper into the earth, further drill pipe members 370*a* are added to the third drill string 370 and the first and second drill string sections 312, 314 move further downhole in general direction shown as arrow "C".

As the bottom hole assembly 344 including drill bit 342 drills deeper and deviates from the vertical as shown in FIG. 4C, the first drill string section 314 follows an angled or curved path that deviates anywhere from a few degrees off the vertical axis to a substantially horizontal axis. However, the second drill string section 312 remains located in the generally vertical riser and vertical section of the well.

The third drill string section 370 may be made of the same drill pipe members 314*a* as the first drill string 314 with external upsets. The external upsets may assist in providing weight on bit.

Optionally, in the event that further managed pressure drilling is required, the RCD is reinstalled or reactivated and a fourth drill string section made of drill pipe members with flush tool joints, similar to second drill string section which are added to the drill string above the third drill section 370. A benefit of an embodiment of the invention is that the RCD may be quickly and easily installed on the riser only when managed pressure drilling is required.

Drill pipe members with flush tool joints connected together to form a parallel pipe drill string may be used for just managed pressure drilling sections of the well in order to ensure an effective seal with the RCD as the flush joint drill string 312 is vertically lowered or raised in the riser 330 and passes through the rotating control device.

Alternatively after the managed pressure drilling well control is switched to conventional well the second drill string 312 (parallel pipe drill string) may be extended rather than providing a third drill string section 370 (conventional pipe drill string). In this case further drill pipe members 312*a* are added to the second drill string section 312.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers.

Furthermore, relative terms such as", "lower", "upper", "up", "down", "above", "below", "uphole", "downhole" and the like are used herein to indicate directions and locations as they apply to the appended drawings and will not be construed as limiting the invention and features thereof to particular arrangements or orientations. It will be appreciated that the terms "portion" and "section" are interchangeable.

One advantage of an exemplary drill pipe apparatus described herein is the ability to apply and maintain an effective seal against the drill pipe while providing a flexible drill string which yields a greater rate of penetration in deviated and horizontal wells.

It will be appreciated that the drill pipe members in the second (upper) drill pipe section or portion may have internal upsets to provide strength to the joints between drill pipe members in the second (upper) drill pipe section or portion.

In the above examples the drill pipe members in the first (lower) drill pipe section or portion are described as having external upsets. It will be appreciated that the drill pipe members in the first (lower) drill pipe section or portion may alternatively have internal upsets.

The invention provides a managed pressure drilling system for use in managed pressure drilling operations. The system comprises a rotating sealing device and a drill string comprising a plurality of drill pipe members arranged in a first drill string section and a second drill string section. Each drill pipe members comprises a first tool joint having a first tool joint outer diameter, a second tool joint having a second tool joint outer diameter and a tubular body between the first and second tool joints having a tubular body outer diameter. The first tool joint outer diameter and second tool joint outer diameter are larger than the tubular body outer diameter in each the drill pipe members in the first drill string portion and first tool joint outer diameter and the second tool joint outer diameter are substantially the same as the tubular body outer diameter in each drill pipe members in the second drill string section The rotating sealing device is configured to form a fluid seal against an outer surface of the second drill string section.

By providing a first or lower drill string section with each drill pipe members having protruding tool joints with optional reinforcing external upsets and a second or upper drill string section having drill pipe members with tool joints which are flush with the main tubular body, the invention facilitates the drilling of wells that deviate from the vertical while maintaining an effective seal around at least a part of the second or upper drill string section.

Providing a flush or parallel drill string section enables the RCD to create a sealing barrier with an outer surface of at least a part of the drill sting section including sections or parts of the drill pipe members where there are flush tool joints. By providing flush tool joints in the second or upper drill string section the RCD is not hindered by protruding tool joints.

The flush or parallel drill string section may also pass though the RCD during drill operations without damaging or causing excessive wear on the sealing elements of the RCD. A lower portion or section of the flush or parallel drill string may be connected to a non-flush or non-parallel lower drill string section with external tool joint upsets. The external tool joint upsets on the lower drill string section may reinforce the connection between the drill pipe members reducing and/or minimising stresses on the tool joints as the lower drill string portion curves or deviates from the vertical.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A managed pressure drilling system comprising:

a rotating sealing device; and a drill string comprising am upper drill string section and a lower drill string section, wherein the upper and lower drill string sections each comprise a plurality of drill pipe members, wherein each drill pipe member has:

a first tool joint having a first tool joint outer diameter;

a second tool joint having a second tool joint outer diameter; and a tubular body between the first and second tool joints having a tubular body outer diameter;

wherein the first tool joint, the second tool joint and the tubular body of drill pipe members of the upper drill string section have substantially the same outer diameter;

wherein the first tool joint outer diameter and/or the second tool joint outer diameter of drill pipe members of the lower drill string section is larger than the tubular body outer diameter of drill pipe member of the lower drill string section; and wherein the rotating sealing device is configured to form a fluid seal against at least a part of the upper drill string section.

2. The system according to claim 1 wherein the rotating sealing device is a rotary control device (RCD), wherein the rotary control device comprises at least one sealing element configured to form and/or maintain a fluid seal against at least a part of the upper drill string section.

3. The system according to claim 1 wherein the upper drill string section has an outer diameter that is substantially uniform along its longitudinal length.

4. The system according to claim 1 wherein the upper drill string section is configured to be located in a substantially vertical portion or section of a wellbore in a riser, liner and/or casing.

5. The system according to claim 1 wherein a first or second tool joint of the upper drill string section is configured to connect to a first or second tool joint of the lower drill string section to connect the upper and lower drill string sections together.

6. The system according to claim 1 wherein the first tool joint and/or the second tool joint of the drill pipe members in the lower drill string section has an external upset and/or an internal upset.

7. The system according to claim 1 wherein the first tool joint and/or the second tool joint of the drill pipe members has an internal upset.

8. The system according to claim 1 wherein the lower drill string section is connected to or configured to be connected to a drill bit.

9. The system according to claim 1 wherein the lower drill string section is configured to be located in a substantially non-vertical, horizontal and/or deviated portion or section of the wellbore.

10. The system according to claim 1 wherein the system is configured for use in managed pressure drilling in a subsea well wherein the system comprises a riser and the rotating sealing device is configured to form a fluid seal between the upper drill string section passing through the rotating sealing device and the riser.

11. The system according to claim 1 wherein the system is configured for use in managed pressure drilling in an onshore well wherein the system comprises a casing and the rotating sealing device is configured to form a fluid seal between the upper drill string section passing through the rotating sealing device and the casing.

12. A drill string assembly for managed pressure drilling comprising:

an upper drill string section connectable to a lower drill string section, wherein the upper and lower drill string sections each comprise a plurality of drill pipe members, wherein each drill pipe member has:

a first tool joint having a first tool joint outer diameter;

a second tool joint having a second tool joint outer diameter; and a tubular body between the first and second tool joints having a tubular body outer diameter;

wherein the outer diameters of the first tool joint, the second tool joint and the tubular body of the drill pipe members of the upper drill string section are substantially equal; and wherein the outer diameters of the first tool joint and/or the second tool joint of the drill pipe members of the lower drill string section is larger than the tubular body outer diameter of the drill pipe member of the lower drill string section.

13. A method for managed pressure drilling, the method comprising:

providing a managed pressure drilling system, the system comprising:

a rotating sealing device; and a drill string comprising an upper drill string section and a lower drill string section, wherein the upper and lower drill string sections each comprise a plurality of drill pipe members, wherein each drill pipe member comprises a tubular pipe body with connectors at either end thereof;

wherein the connectors and the tubular pipe body of each drill pipe member of the upper drill string section have substantially the same outer diameter; and wherein the outer diameter of the connectors of the drill pipe members of the lower drill string section is larger than the tubular pipe body outer diameter of drill pipe members of the lower drill string;

lowering the drill string into a tubular connected to a well;

forming a fluid seal between at least one section of the upper drill string section and a tubular in the well;

passing at least one part of the drill string through the rotating sealing device; and drilling the wellbore.

14. The method according to claim 13 wherein the upper drill string section is connected to the lower drill string section which is connected to a drill bit.

15. The method according to claim 14 comprising drilling a non-vertical or deviating wellbore by deviating the lower drill string section from the vertical.

16. The method according to claim 13 comprising locating the upper drill string section in a substantial vertical section of the tubular and/or well.

17. A method for drilling a well, comprising:

providing a drilling system, the system comprising:

a rotating sealing device; and a plurality of drill pipe members comprising first drill pipe members and second drill pipe members, wherein each drill pipe member comprises a tubular pipe body with connector joints at either end thereof;

wherein first drill pipe members have connector joint outer diameters which are larger than the outer diameter of the tubular pipe body;

wherein second drill pipe members have connector joint outer diameters which are substantially the same as the outer diameter of the tubular pipe body;

wherein the first drill pipe members are configured to be connected to form a first drill string section and the second drill pipe members are configured to be connected to form a second drill string section;

drilling a first section of the well using the first drill string section comprising a plurality of first drill pipe members;

connecting second drill pipe members to the first drill string section;

forming a fluid seal between a tubular connected in the well and an outer surface of at least part of a second drill pipe member in the second drill string section;

passing at least part of the second drill string through the rotating sealing device; and drilling a second section of the well at a pre-determined fluid annular pressure.

18. The method according to claim 17 comprising drilling a first section of the well using conventional drilling and drilling the second section of the well using managed pressure drilling.

19. The method according to claim 17 comprising drilling a third section of the well using conventional drilling or managed pressure drilling.

20. The method according to claim 19 comprising drilling a third section of the well by connecting a third drill string section comprising a plurality of third drill pipe members to an upper portion of the second drill string section.

21. The method according to claim 20 wherein the third section of the well is drilled using conventional drilling wherein the rotating sealing device is removed or deactivated and the third drill pipe members in third drill string section comprise connector joints which are larger than the outer diameter of the tubular pipe body of the third drill pipe members in the third drill string section.

* * * * *